US011214431B2

(12) United States Patent
Borel et al.

(10) Patent No.: US 11,214,431 B2
(45) Date of Patent: Jan. 4, 2022

(54) FLOW REDUCER FOR A PRESSURIZED PRODUCT DISPENSER

(71) Applicant: LINDAL FRANCE SAS, Val-de-Briey (FR)

(72) Inventors: Bernard Borel, Moirans (FR); Hervé Bodet, Verdun (FR)

(73) Assignee: LINDAL FRANCE SAS, Val-de-Briey (FR)

( * ) Notice: Subject to any disclaimer, the term of this patent is extended or adjusted under 35 U.S.C. 154(b) by 0 days.

(21) Appl. No.: 16/977,362

(22) PCT Filed: Mar. 5, 2019

(86) PCT No.: PCT/EP2019/055451
§ 371 (c)(1),
(2) Date: Sep. 1, 2020

(87) PCT Pub. No.: WO2019/174970
PCT Pub. Date: Sep. 19, 2019

(65) Prior Publication Data

US 2021/0107727 A1 Apr. 15, 2021

(30) Foreign Application Priority Data

Mar. 11, 2018 (FR) ..... 1852090

(51) Int. Cl.
*B65D 83/44* (2006.01)
*B65D 83/68* (2006.01)

(52) U.S. Cl.
CPC ..... *B65D 83/44* (2013.01); *B65D 83/682* (2013.01)

(58) Field of Classification Search
CPC .... B65D 83/44; B65D 83/682; B65D 83/685; B65D 83/687; B65D 83/7532
(Continued)

(56) References Cited

U.S. PATENT DOCUMENTS 3,982,668 A 9/1976 Riccio
5,385,303 A 1/1995 Gosselin et al.
(Continued)

FOREIGN PATENT DOCUMENTS

WO 9510463 A1 4/1995
WO 2005082743 A1 9/2009
(Continued)

OTHER PUBLICATIONS

International Search Report and Written Opinion dated Jun. 4, 2019 in corresponding application No. PCT/EP2019/055451; w/ English partial translation and partial machine translation (total 20 pages).

*Primary Examiner* — Vishal Pancholi
(74) *Attorney, Agent, or Firm* — Seckel IP, PLLC

(57) ABSTRACT

A flow reducer (10) for a pressurized product dispenser of the type provided with a valve (30) equipped with a stem (20) having at least a first path, and with a diffuser, is a part separate from the stem and the diffuser, and includes a recess open on one side via an opening and adapted to be fitted by the opening over the stem (20) of a valve (30), one or more first outlet orifices (134) which, when the reducer is mounted on the stem (20) of a valve, are adapted to be connected in a sealed manner to the first path of the stem (20) of the valve, thus forming an extension (133) of the first path, the outer face of the reducer, on the side opposite to the opening of the recess, having in part a contour substantially identical to that of the portion of the stem (20) protruding from the valve which is intended to be covered by the reducer.

20 Claims, 3 Drawing Sheets

Figure 1:
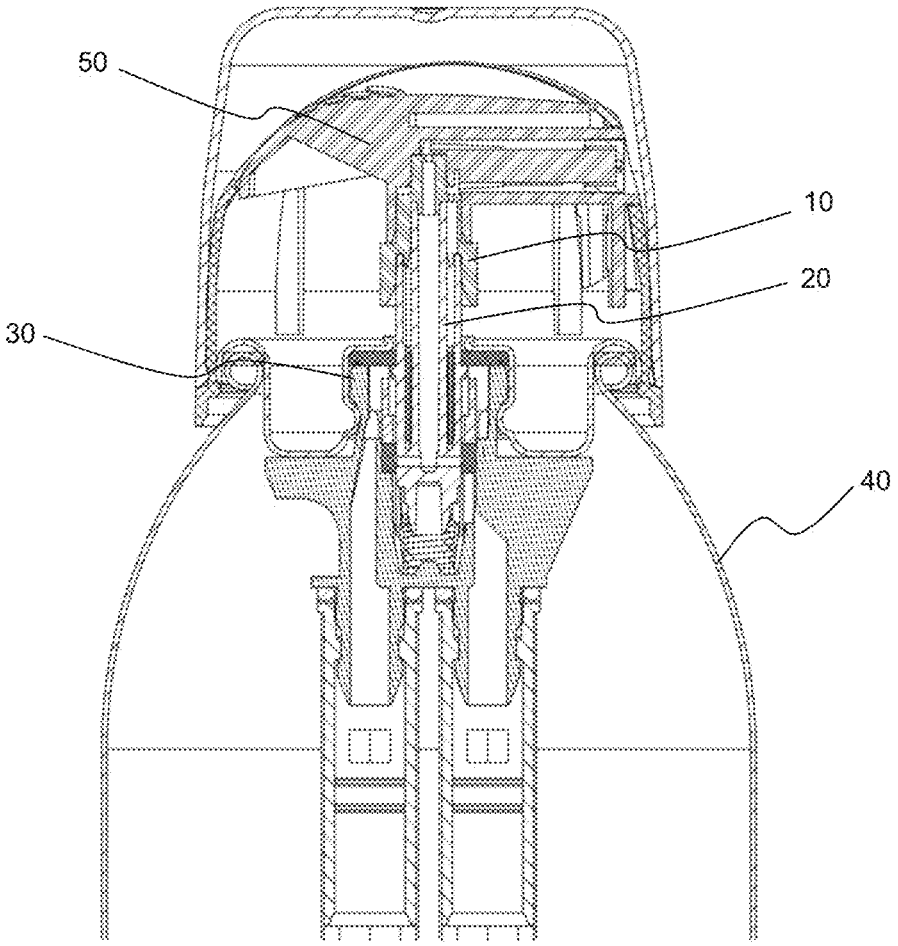

(58) Field of Classification Search
USPC ..... 222/402.15
See application file for complete search history.

(56) References Cited

U.S. PATENT DOCUMENTS

| | | | |
|---|---|---|---|
| 9,192,948 | B2 | 11/2015 | Bodet et al. |
| 2008/0230566 | A1 | 9/2008 | Frutin |
| 2013/0284293 | A1 | 10/2013 | Bodet et al. |

FOREIGN PATENT DOCUMENTS

| | | | |
|---|---|---|---|
| WO | 2009134129 | A1 | 11/2009 |
| WO | 2012045562 | A1 | 4/2012 |
| WO | 2016181823 | A1 | 11/2016 |

FLOW REDUCER FOR A PRESSURIZED PRODUCT DISPENSER

The invention relates to a flow reducer for a pressurized product dispenser, in particular for an aerosol generator of the type provided with a diffuser and a valve equipped with a stem.

Pressurized product dispensers are commonly used in many areas. To distribute their content, they are equipped with valves provided with a stem. Depending on the needs, these valves can be one-way valves or two-way valves. Two-way valves are used when two products must be kept separate until the time of their simultaneous application. For this purpose, the products are stored in two different reservoirs, which are generally two pouches, arranged side by side or one in the other, or one product in a pouch and the other product in the aerosol can. Two-way valves can also be used to distribute the product contained in the dispenser through a first path and the propellant gas through the other path, the product being contained, if needed, in a pouch protected from the propellant gas. To actuate the valve, a diffuser is placed at the top of the stem. When the diffuser is used with a two-way valve, the two products come in contact with each other only at the outlet of the stem, or even at the outlet of the diffuser. To introduce the product or products into the pressurized product dispensers, it is common practice to make them enter their respective reservoirs (pouches or cans) via the valve, and therefore, via the paths extending through the stem. The less viscous the products, and the larger the transverse cross-sections of the paths, the simpler and quicker this operation. However, if entry of the product is facilitated, its exit is also made easier. But in order to obtain a good aerosol or a good foam, it can be necessary to limit the flow rate of the product leaving the valve. In the case of two-way valves, it can also be necessary that the two products do not come out at the same flow rate. Likewise, when the two products have different viscosities, it can be necessary to adapt the transverse cross-sections of the paths to obtain the desired flow rate for each of the products. Until now, the adaptation of the transverse cross-sections of the paths to guarantee the desired flow rate of the product or of each of the two products has been done in the stem, through the choice of size and number of orifices giving access to the paths of the stem, and in the diffuser, via the nozzle outlet. This means that each stem and each nozzle must be adapted on a case-by-case basis, which requires different molds for their manufacture, and large stocks. In addition, the choice of size and number of orifices in the stems can limit the filling speed when the container is filled via the valve, and thus through the stem.

The objective of the invention is to make it possible to adjust the flow rate of a valve, whether a one-way or a two-way valve, to the requirements linked to the products to be applied, while keeping a stem having the largest possible paths. Preferably, the reducer will be designed to make it possible to also keep the other standard components.

This objective is achieved in that the flow reducer is constituted by a part which is separate from the stem and preferably from the diffuser, and which comprises

- a recess open on one side by an opening and adapted to be fitted by the opening over the stem of a valve,
- one or more first outlet orifices which, when the reducer is mounted on the stem, are adapted to be connected in a sealed manner to the first path of the stem, thus forming an extension of the first path of a valve, the outer face of the reducer, on the side opposite to the opening of the recess, preferably having a contour which is in part substantially identical to that of the portion of the stem protruding from the valve and intended to be covered by the reducer.

When the flow reducer is intended for a two-way valve equipped with a two-way stem having a first path and a second path, the flow reducer can further comprise

- one or more second outlet orifices which, when the reducer is mounted on the stem of a two-way valve, are adapted to be connected in a sealed manner to the second path of the stem of the two-way valve, thus forming an extension of the second path,
- sealing means which, when the reducer is mounted on the stem of a two-way valve, are adapted to maintain the separation of the two paths at the junction between the reducer and the stem on which it is mounted, and between this junction and the outlet orifices.

Once mounted on the stem, the reducer extends the path, or the two paths which remain isolated from one another until the outlet orifices. It is sufficient to adapt the number and/or the cross-section of the outlet orifices to adjust the flow rate of the products in each path. This way, it is possible to keep stems having paths of large cross-sections, and standard diffusers. Only the reducer, an element which is simple to manufacture, is adapted on a case-by-case basis. The reducer can be used both for stems with a single path and for stems with two concentric paths or two parallel paths.

Whether a stem with a single path or a stem with two concentric paths, the stem has generally a first tubular wall defining the first path. In this case, the reducer preferably comprises:

- a first path cylindrical wall defining a first path cylindrical space forming at least a portion of the recess and having a first end oriented toward the opening of the recess and a second end opposite to the opening of the recess, wherein, when the reducer is mounted on the stem of a valve, the first path cylindrical wall is adapted to surround at least in part the first tubular wall of the stem
- a top closure wall in the extension of the second end of the first path cylindrical wall, said top closure wall closing the first path cylindrical space;
- the first outlet orifice or orifices being made in the top closure wall in an area of the top closure wall which, when the reducer is mounted on the stem of a valve, is adapted to be in contact with the first path of the stem.

To allow the flow reducer to have, on its outer face opposite to the opening of the recess, the shape of the first tubular wall of the stem for which it is intended, it is preferable that

- the flow reducer comprises a top cylindrical wall defining a top cylindrical space whose transverse cross-section is smaller than the transverse cross-section of the first path cylindrical space, and that
- the top closure wall is divided into
  - a first top closure wall connecting the second end of the first path cylindrical wall to a first end of the top cylindrical wall; and
  - a second top closure wall in the extension of the second end of the top cylindrical wall, opposite to the first top closure wall, and closing the top cylindrical space,
- the first path cylindrical space and the top cylindrical space forming at least a portion of the recess adapted to be fitted over a stem;
- the first outlet orifice or orifices being made in the second top closure wall in an area of the second top closure wall which, when the reducer is mounted on the stem of a valve, is adapted to be in contact with the first path of the stem.

When the reducer is intended for a valve with two concentric paths whose stem has a first tubular wall defining the first path and a second tubular wall partly surrounding the first tubular wall and defining the second path, it is preferable that the flow reducer further comprises

- a second path cylindrical wall defining a second path cylindrical space forming at least a portion of the recess and having a first end oriented toward the opening of the recess and a second end opposite to the opening, wherein, when the reducer is mounted on the stem of a two-way valve, the second path cylindrical wall is adapted to surround at least in part the second tubular wall of the stem;
- an intermediate closure wall connecting the second end of the second path cylindrical wall to the first end of the first path cylindrical wall;
- the second outlet orifice or orifices being made in the intermediate closure wall in an area of the intermediate closure wall adapted to be in contact with the second path of the stem.

Such a flow reducer allows the products to remain separated until they leave the reducer. If the separation must continue until within the diffuser, or even until the outlet of the diffuser, the top cylindrical wall and the separation of the top closure wall into a first top closure wall and a second top closure wall will be provided, as indicated previously. If, on the contrary, a separation of the products beyond the stem is not necessary, it is possible to dispense with the top cylindrical wall.

In order to carry out the extension of the second path, it can be provided to make one or more channels in the first path cylindrical wall, which channels extend to the top closure wall or to the first top closure wall, each channel opening into one or more of the second outlet orifices.

To ensure sealing, on the one hand, at the junction between the flow reducer and the stem, and on the other hand, between the extension of the first path and the extension of the second channel, it is preferable to provide

- a first path sealing end-piece on the top closure wall or at the first end of the top cylindrical wall, wherein, when the reducer is mounted on the stem of a two-way valve, the first path sealing end-piece is adapted to be introduced into the first path of the valve stem, thus ensuring sealing at the junction between the first path of the valve stem and the flow reducer, and/or
- a second path sealing end-piece placed at the first end of the first path cylindrical wall, wherein, when the reducer is mounted on the stem of a two-way valve, the second path sealing end-piece is adapted to be introduced into the second path of the stem, thus ensuring sealing at the junction between the second path of the stem and the flow reducer.

It is preferable that the outer contour of the first path cylindrical wall is adapted to cooperate with a diffuser, preferably with a diffuser adapted to cooperate with a stem for which the flow reducer is intended. In particular, the outer contour of the top cylindrical wall can be adapted to cooperate with a diffuser for single-way or two-way valve, in particular a diffuser adapted to cooperate with a stem for which the flow reducer is intended. In such a case, the outer contour of the reducer at the first path cylindrical wall and, where appropriate, at the top cylindrical wall, is preferably substantially identical to the contour of the stem on which it is mounted, so that it cooperates with the diffuser as the stem would have done. This way, it is possible to use the same diffusers for the bare stems or for the stems equipped with a reducer. If using the same diffusers is not required, and specific diffusers can be produced, this identity of form can be dispensed with.

The flow reducer can be sold separately. It can also be sold associated with the valve and/or the diffuser for which it is intended, in particular in the form of a set. It is also conceivable that the reducer is sold pre-assembled on the diffuser for which it is intended.

Figure 2:
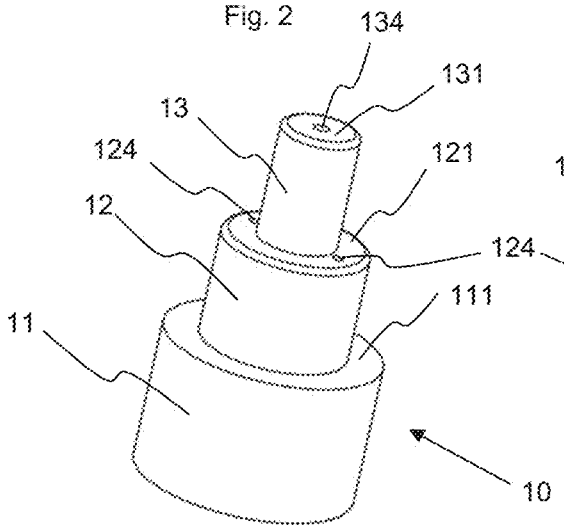
Figure 3:
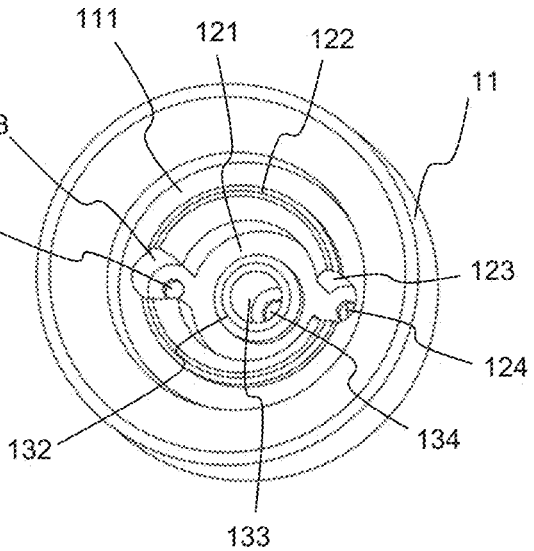
Figure 4:
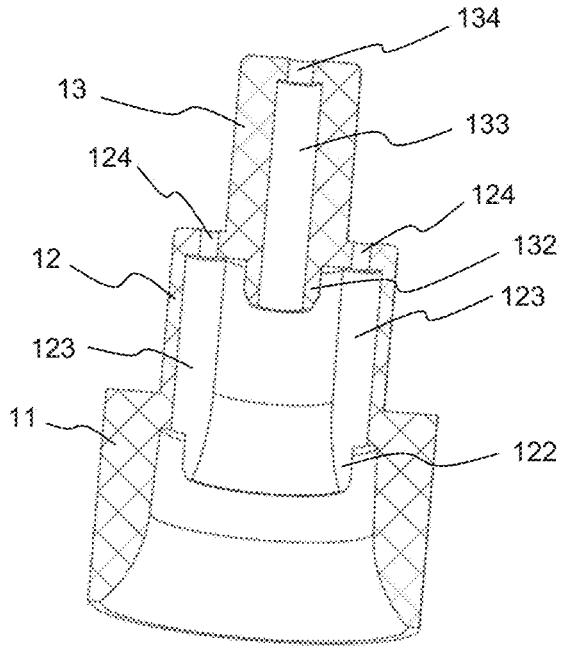
Figure 5:
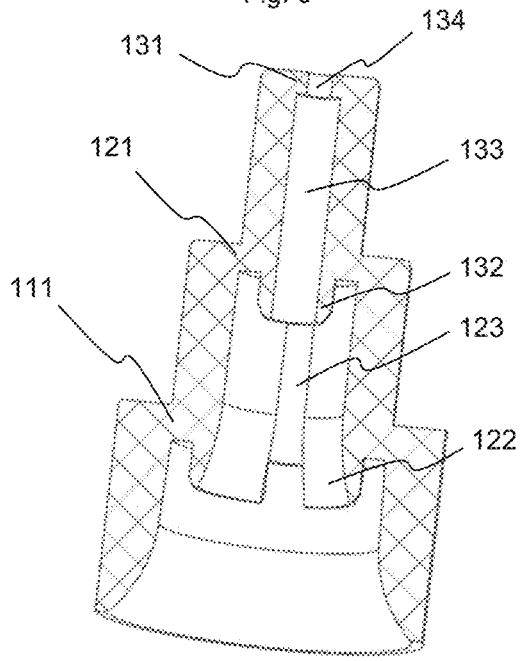
Figure 6:
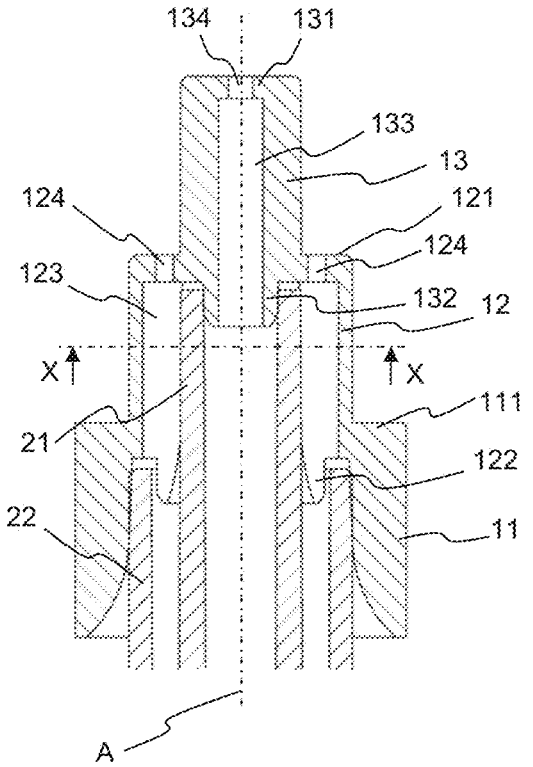
Figure 7:
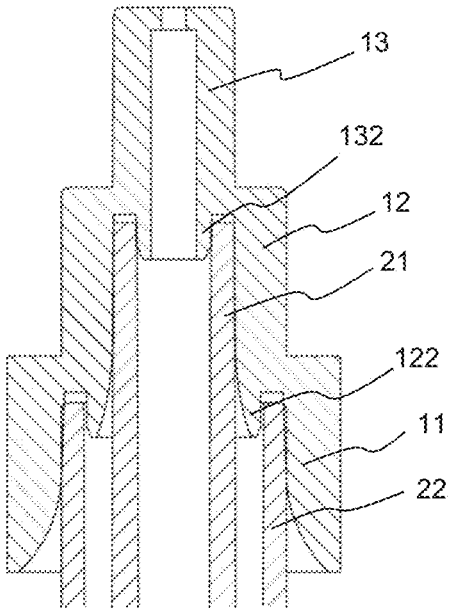
Figure 8:
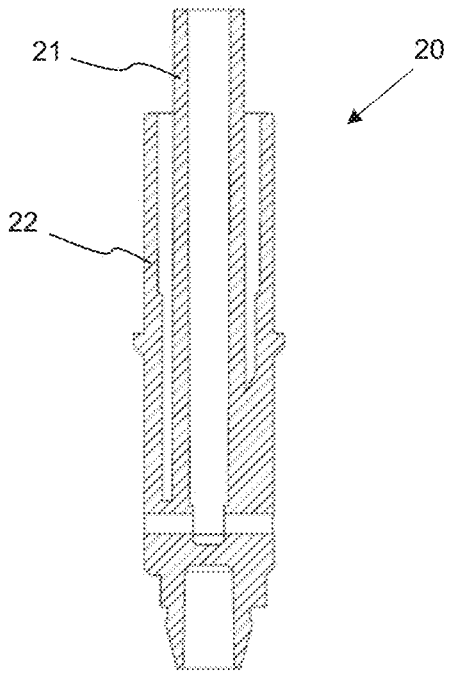
Figure 9:
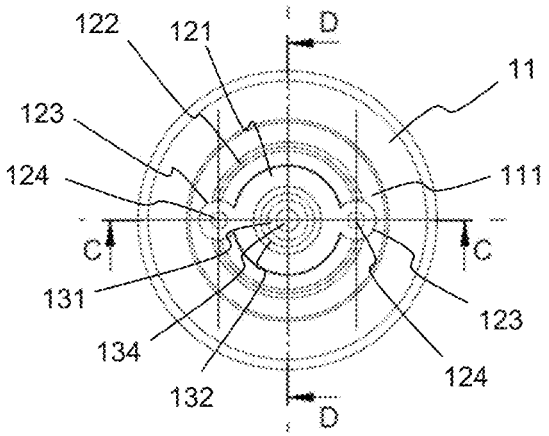

The invention is explained in more detail below with the assistance of the figures which show:

FIG. 1 Cross-sectional view of a flow reducer according to the invention mounted on a concentric two-way valve and surmounted by a diffuser;

FIG. 2 Top perspective view of a flow reducer of the invention;

FIG. 3 Bottom perspective view of the flow reducer of FIG. 2;

FIG. 4 Cross-sectional view of the reducer of FIG. 2 along the cross-sectional plane CC of FIG. 9;

FIG. 5 Cross-sectional view of the reducer of FIG. 2 along the cross-sectional plane DD of FIG. 9;

FIG. 6 Cross-sectional view as in FIG. 4, the reducer being mounted on a stem;

FIG. 7 Cross-sectional view as in FIG. 5, the reducer being mounted on a stem;

FIG. 8 Cross-sectional view of a two-way stem on which the flow reducer of the invention can be mounted;

FIG. 9 Bottom view of the reducer of FIG. 2; and

Figure 10:
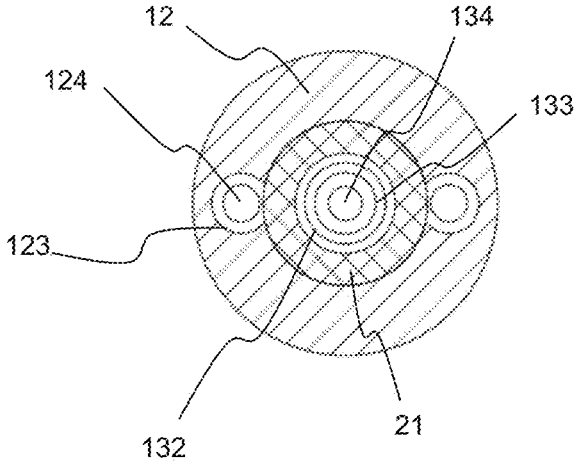

FIG. 10 Cross-sectional view along cross-sectional XX of FIG. 6 of the flow reducer of FIG. 2 fitted over the stem of FIG. 8, at the second cylindrical wall of the flow reducer.

The invention concerns a flow reducer (10) for a stem (20) of a one-way or two-way valve (30) used with a can (40) in pressurized containers. Such stems (20) are sometimes referred to as valve rods. The flow reducer is intended to be placed between the free end of the stem (20) protruding outside the valve and the diffuser (50), itself usually placed directly on this protruding end.

In the case of two-way valves, the stems (20) may be of the type with concentric paths, as in the example presented here (see in particular FIG. 8), or of the type with parallel paths.

A two-way valve stem can be used in a two-way valve (30) with parallel pouches, such as that shown by way of example in FIG. 1, or with concentric pouches (bag-in-bag).

The stem and the flow reducer of the invention usually have a certain rotational symmetry about a main axis (A) passing through the stem and the flow reducer. It will be seen that this rotational symmetry is not absolute, as certain portions of the reducer deviate from it. The adjectives "axial" or "radial" refer to this main axis (A) and define an element respectively parallel or perpendicular to this axis. To simplify the description, the spatial references such as "top" and "bottom", or "upper" and "lower", refer to the flow reducer and to the stem as shown in FIG. 1, for example. These are not absolute positions, as the valve on which the flow reducer of the invention is mounted can be used upwards (as in FIG. 1), downwards, or more generally, in any position adapted to the product to be delivered.

A stem for a one-way valve generally comprises a first tubular wall forming a cylindrical channel that is open upwards and forms part of the single path. When the valve is open, this single path communicates with the inside of the can or with a reservoir placed inside the can, such as a flexible pouch.

When the stem is intended for a two-way valve, this first tubular wall (21) is surrounded in part by a second tubular wall (22) forming an annular channel that is open upwards and forms part of the second path. The second tubular wall (22) generally does not extend as high as the central first tubular wall (21). When the valve is open, each path of the stem communicates with its respective reservoir, generally a flexible pouch or the inside of the can, in a known manner via the valve. It is also possible that the product to be dispensed is contained directly in the can with the propellant gas, the product exiting by the first path and the propellant gas by the second path. To simplify the remainder of the description, reference will be made generally to pouches, without this being a limitation, as these pouches may be replaced by any other type of reservoir capable of fulfilling the same function.

The flow reducer (10) of the invention is fitted over the protruding end of the stem and can maintain the separation of the paths when it is intended for a two-way valve.

The invention is explained in more detail below with the aid of a reducer for concentric two-way valve. In the example presented here, the flow reducer (10) is constituted by three main portions: a first cylindrical wall (11), corresponding to the second path cylindrical wall, a second cylindrical wall (12), corresponding to the first path cylindrical wall, and a third cylindrical wall (13), corresponding to the top cylindrical wall, each defining a cylindrical inner space.

The first end (lower end) of the first cylindrical wall (11) is open and constitutes the lower end of the flow reducer (10). The second end (upper end) of the first cylindrical wall (11) and the first end (lower end) of the second cylindrical wall (12) are connected together by a first radial wall (111), corresponding to the intermediate closure wall. The second end (upper end) of the second cylindrical wall (12) and the first end (lower end) of the third cylindrical wall (13) are connected together by a second radial wall (121), corresponding to the first top closure wall. Finally, the third cylindrical wall (13) is closed at its second end (upper end) by a third radial wall (131), corresponding to the second top closure wall. These three radial walls participate in closing the inner spaces defined by the three cylindrical walls and constitute closure walls. The cylindrical walls and the radial walls all together define a recess corresponding to the three cylindrical spaces. The recess is open at the free end of the first cylindrical wall (first end opposite to the first closure wall (111)). It will be seen that this recess is adapted to be fitted by the opening of the recess over a two-way stem, without the stem necessarily penetrating into the back end of the recess. In particular, the stem is not intended to penetrate into the top cylindrical space. The three main walls (11, 12, 13) of the flow reducer (10) are not necessarily absolutely cylindrical. They can be slightly frustoconical, generally in a non-perceptible manner, to facilitate demolding. This deviation from a perfectly cylindrical shape is expressed by the term "substantially" cylindrical, simplified below by the adjective "cylindrical". Likewise, the closure walls (111, 121, 131) are here radial, but they could be inclined or of any other suitable shape.

The inner diameter of the first cylindrical wall (11) of the flow reducer is substantially equal to or slightly smaller than the outer diameter of the second tubular wall (22) of the stem. The inner diameter of the second cylindrical wall (12) is substantially equal to or slightly smaller than the outer diameter of the first tubular wall (21) of the stem. This is clearly visible in FIGS. 6 and 7.

In addition, the outer diameter of the second cylindrical wall (12) of the flow reducer is substantially equal to the outer diameter of the second tubular wall (22) of the stem, and the outer diameter of the third cylindrical wall (13) is substantially equal to the outer diameter of the first tubular wall (21) of the stem. This is also visible in FIGS. 6 and 7. Thus, the outer contour of the reducer, at the second and third cylindrical walls, is substantially identical to the outer contour of the upper portion of the stem intended to penetrate into the diffuser (50).

When the flow reducer is mounted on a stem (20), the first tubular wall (21) of the stem penetrates into the second cylindrical wall (12) of the reducer and the second tubular wall (22) of the stem penetrates into the first cylindrical wall (11) of the reducer. The inner diameters of the first and of the second cylindrical wall (11, 12) are therefore chosen to ensure permanent contact between the inner face of this cylindrical wall (11, 12) and the outer face of the corresponding tubular wall (21, 22) of the stem (see in particular FIGS. 6 and 7). The assembly requires application of a slight force to overcome the friction of the walls against each other, which ensures that the flow reducer remains on the stem without the risk of it going away. The inner diameter of the cylindrical walls (11, 12) should not be too small either, so that the assembly does not require too much force, which could damage the stem or the flow reducer.

The height of the outer face of the third cylindrical wall (13) is preferably substantially equal to the difference in height between the top of the first tubular wall (21) and the top of the second tubular wall (22) of the stem. The inner height of the first cylindrical wall (11) and that of the second cylindrical wall (12) are chosen so that the two tubular walls (21, 22) of the stem are each in contact with at least a portion of the inner face of the corresponding cylindrical wall (22/11, 21/12) when the flow reducer is mounted on a stem, also ensuring, on the one hand, the continuity of the two paths, and on the other hand, their sealed separation. It is not necessary for the first cylindrical wall (11) of the flow reducer to be as high as the protruding portion of the second tubular wall (22) of the stem.

In order to ensure sealing between the two paths, the third cylindrical wall (13) can be extended downwards, inside the second cylindrical wall (12), by a first path sealing end-piece (132), whose outer diameter is substantially equal to the inner diameter of the first tubular wall (21) of the stem. Likewise, the second cylindrical wall (12) of the reducer can be extended downwards, inside the first cylindrical wall (11), by a second path sealing end-piece (122), whose outer diameter is substantially equal to the inner diameter of the second tubular wall (22) of the stem. Due to the tight fit of the first cylindrical wall (11) over the second tubular wall (22) of the stem, on the one hand, and of the second cylindrical wall (12) over the first tubular wall (21) of the stem, on the other hand, it would be possible to dispense with the second path sealing end-piece (122).

To facilitate the installation of the reducer on the stem, it is preferable to chamfer the inside of the first and the second cylindrical wall (11, 12) at their respective lower ends in order to enable a self-centering effect of the reducer with respect to the stem. When a second path sealing end-piece (122) is provided, it is sufficient to chamfer its inner face, without the chamfer necessarily reaching the inner face of the second cylindrical wall (12). Likewise, it can be provided to chamfer the outer face of the two sealing end-pieces (121, 131).

A central channel (133) of substantially constant diameter passes through the third cylindrical wall (13) from its lower end, or from the lower end of the sealing end-piece (132) when there is one, to the third radial wall (131) that close the third cylindrical wall (13). A central outlet orifice (134) is made in the third radial wall to bring the central channel (133) in contact with the outside of the reducer. This outlet orifice (134) corresponds to one of the first outlet orifices. Rather than a single orifice, it would be possible to provide several orifices in the third radial wall (131). Likewise, one or several side channels (123), here, two side channels, can be made in the thickness of the second cylindrical wall (12). These channels extend from the lower end of the second cylindrical wall, or from the second path sealing end-piece (122) when there is one, to the second radial wall (121) that closes the second cylindrical wall. Each side channel (123) ends with one or more outlet orifices (124) made in the second radial wall (121) that closes the second cylindrical wall. These outlet orifices (124) correspond to the second outlet orifices. The side channels (123) can be made entirely within the mass of the cylindrical wall (12), or they can be included only partially in this wall, as is the case in the example presented here. This is clearly visible in FIGS. 3 and 5. In this case, the outer face of the first tubular wall (21) of the stem closes the side wall of the tubular side channels (123), as clearly shown in FIG. 6 and FIG. 10.

The flow reducer (10) is preferably made of a plastic material, for example, a flexible polyolefin to facilitate the assembly with a tight fit and to participate in the sealing of the flow reducer (10) on the stem (20).

When the flow reducer is mounted on a stem, the product contained in the first reservoir (generally a first pouch) leaves the valve by the first path, which ends in the central channel located in the first tubular wall (21) of the valve stem. The product leaving the stem via this first path enters the central channel (133) of the third cylindrical wall of the flow reducer and leaves through the outlet orifice (134) at the top of the flow reducer. The central channel (133) therefore constitutes an extension of the first path. The product contained in the second pouch (or in the can) leaves the valve via the second path, which ends in the annular channel defined between the first tubular wall (21) and the second tubular wall (22) of the stem. The product leaving the stem via this second path enters the two side channels (123) and exits through the outlet orifices (124) located on the second radial wall (121) at the junction between the second and third cylindrical walls (12, 13). The side channels (123) therefore constitute an extension of the second path. Upon leaving the orifices (124, 134), the products enter the diffuser as they would have done if they had come directly from the stem. The first path sealing end-piece (132) ensures the separation of the two products. The second path sealing end-piece (122) participates in sealing the second path from the outside.

The transverse cross-section of the outlet orifices (124, 134) and/or the number of side channels (123) are chosen according to needs, namely, the ratio between the two products to be dispensed, taking into account the viscosity of each. It is thus possible to have several different flow reducers for the same set of stem and diffuser. A stem having two paths of large transverse cross-sections is kept, which allows filling the pouches quickly, while being able to adapt the output flow rate thanks to the reducer of the invention. Due to its outer contour having the same dimensions as those of the stem, it is not necessary to modify the diffusers, which can be fitted over the reducer as they would be over a stem. At most, the height of the diffuser skirt can be adapted to compensate for the additional height due to the presence of the flow reducer, if this skirt needs to extend down to the valve cup or to the can. The reducer can be supplied alone, mounted in a diffuser, or even temporarily placed on a two-way valve.

If separating the paths is no longer necessary when leaving the valve, it is possible to dispense with the third cylindrical wall (13). In this case, the second radial wall (121) closing the top of the second cylindrical wall (12) extends over the entire transverse cross-section of the channel defined by the cylindrical wall (12), the central outlet orifice (134) being produced in the center of this radial wall (121) so as to face the first path of the stem defined by the first tubular wall (21). It can even be envisioned to dispense with the first path sealing end-piece 132.

The person skilled in the art understands that the system can be adapted to stems with parallel rather than concentric paths. In this case, the flow reducer is provided with two non-concentric parallel paths, each with one or more outlet orifices whose transverse cross-section is adjusted on a case-by-case basis.

It should be noted that the flow reducer of the invention has almost no effect on pressure and does not fulfill the function of a pressure reducer.

When the flow reducer is intended for a single-way valve, it is not necessary to provide the first cylindrical wall (11), nor the channels (123), nor the second orifices (124).

The person skilled in the art also understands that it would be possible to adapt the flow reducer to stems comprising more than two paths, for example, stems with three parallel or concentric paths.

The reducer of the invention can be used for any type of aerosol, for the application of pasty products, for foams, gels or liquids. It can be applied to bag-on valves, whose pouches can be welded or snapped onto the valve body.

LIST OF REFERENCES

10 Flow reducer
- 11 First cylindrical wall (second path cylindrical wall)
  - 111 First radial wall (intermediate radial wall)
- 12 Second cylindrical wall (first path cylindrical wall)
  - 121 Second radial wall (first top closure wall)
  - 122 Second path sealing end-piece
  - 123 Side channels
  - 124 2nd side outlets
- 13 Third cylindrical wall (top cylindrical wall)
  - 131 Third radial wall (second top closure wall)
  - 132 First path sealing end-piece
  - 133 Central outlet channel
  - 134 1st central outlet orifice

20 Stem
- 21 First tubular wall
- 22 Second tubular wall

30 Valve
40 Can
50 Diffuser
A Main axis

The invention claimed is:

1. Flow reducer for a pressurized product dispenser of the type provided with a diffuser and a valve equipped with a stem having at least a first tubular wall defining a first path, wherein the flow reducer is a part separate from the stem and the diffuser, and wherein the flow reducer comprises a recess open on one side by an opening and adapted to be fitted by the opening over a stem of a valve, one or more first outlet orifices which, when the reducer is mounted on a stem of a valve, are adapted to be connected in a sealed manner to a first path of the stem of the valve, thus forming an extension of the first path, a first path cylindrical wall defining a first path cylindrical space forming at least a portion of the recess and having a first end oriented toward the opening of the recess and a second end opposite to the opening of the recess, wherein, when the reducer is mounted on a stem of a valve, the first path cylindrical wall is adapted to surround at least in part a first tubular wall of the stem, and a top closure wall in the extension of the second end of the first path cylindrical wall, the top closure wall closing the first path cylindrical space, wherein an outer face of the reducer, on the side opposite to the opening of the recess, has in part a contour substantially identical to a contour of a portion of the stem which protrudes from the valve and which is intended to be covered by the reducer, and wherein the first outlet orifice or orifices is or are made in the top closure wall in an area of the top closure wall which, when the reducer is mounted on a stem of a valve, is adapted to be in contact with a first path of the stem.

2. Flow reducer according to claim 1, intended for a two-way valve equipped with a two-way stem having a first path and a second path, wherein the flow reducer comprises:

one or more second outlet orifices which, when the reducer is mounted on a stem of a two-way valve, are adapted to be connected in a sealed manner to a second path of the stem of the two-way valve, thus forming an extension of the second path, sealing means which, when the reducer is mounted on a stem of a two-way valve, are adapted to maintain a separation of the first and second paths at a junction between the reducer and the stem on which the reducer is mounted and between the junction and the outlet orifice or orifices.

3. Flow reducer according to claim 1, wherein the flow reducer comprises a top cylindrical wall defining a top cylindrical space having a transverse cross-section smaller than a transverse cross-section of the first path cylindrical space, and the top closure wall is divided into a first top closure wall connecting a second end of the first path cylindrical wall to a first end of the top cylindrical wall; and a second top closure wall in the extension of a second end of the top cylindrical wall, opposite to the first top closure wall, and closing the top cylindrical space, the first path cylindrical space and the top cylindrical space forming at least a portion of the recess adapted to be fitted over a stem;

the first outlet orifice or orifices being made in the second top closure wall in an area of the second top closure wall which, when the reducer is mounted on a stem of a valve, is adapted to be in contact with a first path of the stem.

4. Flow reducer according to claim 1, intended for a stem of a valve with two concentric paths, having a first tubular wall defining the first path and a second tubular wall partially surrounding the first tubular wall and defining the second path, wherein the flow reducer further comprises:

a second path cylindrical wall defining a second path cylindrical space forming at least a portion of the recess and having a first end oriented toward the opening of the recess and a second end opposite to the opening, wherein, when the reducer is mounted on a stem of a two-way valve, the second path cylindrical wall is adapted to surround at least in part a second tubular wall of the stem;

an intermediate closure wall connecting a second end of the second path cylindrical wall to the first end of the first path cylindrical wall;

the second outlet orifice or orifices being made in the intermediate closure wall in an area of the intermediate closure wall adapted to be in contact with a second path of the stem.

5. Flow reducer according to claim 4, wherein one or more channels are made in the first path cylindrical wall, the channels extending to the top closure wall or to the first top closure wall, each channel opening into one or more of the second outlet orifices.

6. Flow reducer according to claim 4, wherein at least one selected from the group consisting of a first path sealing end-piece is provided on the top closure wall or at the first end of the top cylindrical wall, wherein, when the reducer is mounted on a stem of a two-way valve, the first path sealing end-piece is adapted to be introduced into a first path of the stem, thus ensuring sealing at the junction between the first path of the stem and the flow reducer, and a second path sealing end-piece is provided at the first end of the first path cylindrical wall, wherein, when the reducer is mounted on a stem of a two-way valve, the second path sealing end-piece is adapted to be introduced into a second path of the stem, thus ensuring sealing at a junction between the second path of the stem and the flow reducer.

7. Flow reducer according to claim 1, wherein an outer contour of the first path cylindrical wall is adapted to cooperate with a diffuser.

8. Flow reducer according to claim 3, wherein an outer contour of the top cylindrical wall is adapted to cooperate with a diffuser for two-way valve.

9. Flow reducer according to claim 1, wherein the flow reducer is mounted on a diffuser.

10. Kit consisting of at least one valve provided with a stem and at least one flow reducer according to claim 1.

11. Diffuser kit comprising a diffuser and a flow reducer according to claim 1 mounted on the diffuser.

12. Diffuser kit according to claim 11, wherein the diffuser has a single path.

13. Diffuser kit according to claim 11, wherein the diffuser has two at least partly separate paths.

14. Flow reducer according to claim 1, wherein an outer contour of the first path cylindrical wall is adapted to cooperate with a diffuser adapted to cooperate with a stem for which the flow reducer is intended.

15. Flow reducer according to claim 3, wherein an outer contour of the top cylindrical wall is adapted to cooperate with a diffuser for two-way valve adapted to cooperate with a stem of a two-way valve for which the flow reducer is intended.

16. Flow reducer according to claim 3, intended for a stem of a valve with two concentric paths, having a first tubular wall defining the first path and a second tubular wall partially surrounding the first tubular wall and defining the second path, wherein the flow reducer further comprises:

a second path cylindrical wall defining a second path cylindrical space forming at least a portion of the recess and having a first end oriented toward the opening of the recess and a second end opposite to the opening, wherein, when the reducer is mounted on a stem of a two-way valve, the second path cylindrical wall is adapted to surround at least in part a second tubular wall of the stem;

an intermediate closure wall connecting a second end of the second path cylindrical wall to the first end of the first path cylindrical wall;

the second outlet orifice or orifices being made in the intermediate closure wall in an area of the intermediate closure wall adapted to be in contact with a second path of the stem.

17. Flow reducer according to claim 16, wherein one or more channels are made in the first path cylindrical wall, the channels extending to the top closure wall or to the first top closure wall, each channel opening into one or more of the second outlet orifices.

18. Flow reducer according to claim 5, wherein at least one selected from the group consisting of a first path sealing end-piece is provided on the top closure wall or at the first end of the top cylindrical wall, wherein, when the reducer is mounted on a stem of a two-way valve, the first path sealing end-piece is adapted to be introduced into a first path of the stem, thus ensuring sealing at the junction between the first path of the stem and the flow reducer, and a second path sealing end-piece is provided at the first end of the first path cylindrical wall, wherein, when the reducer is mounted on a stem of a two-way valve, the second path sealing end-piece is adapted to be introduced into a second path of the stem, thus ensuring sealing at a junction between the second path of the stem and the flow reducer.

19. Flow reducer according to claim 16, wherein at least one selected from the group consisting of a first path sealing end-piece is provided on the top closure wall or at the first end of the top cylindrical wall, wherein, when the reducer is mounted on a stem of a two-way valve, the first path sealing end-piece is adapted to be introduced into a first path of the stem, thus ensuring sealing at the junction between the first path of the stem and the flow reducer, and a second path sealing end-piece is provided at the first end of the first path cylindrical wall, wherein, when the reducer is mounted on a stem of a two-way valve, the second path sealing end-piece is adapted to be introduced into a second path of the stem, thus ensuring sealing at a junction between the second path of the stem and the flow reducer.

20. Flow reducer according to claim 17, wherein at least one selected from the group consisting of a first path sealing end-piece is provided on the top closure wall or at the first end of the top cylindrical wall, wherein, when the reducer is mounted on a stem of a two-way valve, the first path sealing end-piece is adapted to be introduced into a first path of the stem, thus ensuring sealing at the junction between the first path of the stem and the flow reducer, and a second path sealing end-piece is provided at the first end of the first path cylindrical wall, wherein, when the reducer is mounted on a stem of a two-way valve, the second path sealing end-piece is adapted to be introduced into a second path of the stem, thus ensuring sealing at a junction between the second path of the stem and the flow reducer.

* * * * *